11/19/85 2 XR 4,553,428

United States Patent [19]

Upchurch

[11] Patent Number: 4,553,428

[45] Date of Patent: Nov. 19, 1985

[54] DRILL STEM TESTING APPARATUS WITH MULTIPLE PRESSURE SENSING PORTS

[75] Inventor: James M. Upchurch, Sugar Land, Tex.

[73] Assignee: Schlumberger Technology Corporation, New York, N.Y.

[21] Appl. No.: 549,361

[22] Filed: Nov. 3, 1983

[51] Int. Cl.[4] ..... E21B 47/06

[52] U.S. Cl. ..... 73/152; 73/155; 175/48

[58] Field of Search ..... 73/155, 152; 175/48; 166/250

[56] References Cited

U.S. PATENT DOCUMENTS

| | | | |
|---|---|---|---|
| 3,478,584 | 11/1969 | Strubhar et al. | 73/155 |
| 3,981,188 | 9/1976 | Barrington et al. | 73/155 |
| 4,426,882 | 1/1984 | Skinner | 73/155 |

*Primary Examiner*—Howard A. Birmiel

[57] ABSTRACT

In accordance with an illustrative embodiment of the present invention, a drill stem testing apparatus includes a housing leaving a full-opening bore, and a main test valve for opening and closing the bore in order to flow and shut-in the formation interval being tested. The apparatus further includes a first port means for communicating the pressure of fluids in the bore below the test valve to a first pressure transducer, a second port means for communicating the pressure of fluids in the bore above the test valve to a second pressure transducer, and a third port means for communicating the pressure of fluids in the well annulus externally of the housing to a third pressure transducer. The outputs of the respective transducers are fed to a recording gauge so that a pressure record is obtained of the changes in fluid pressure that occur in the bore of the housing above and below the test valve as well as in the annulus externally of the housing.

12 Claims, 16 Drawing Figures

Fig. 3E
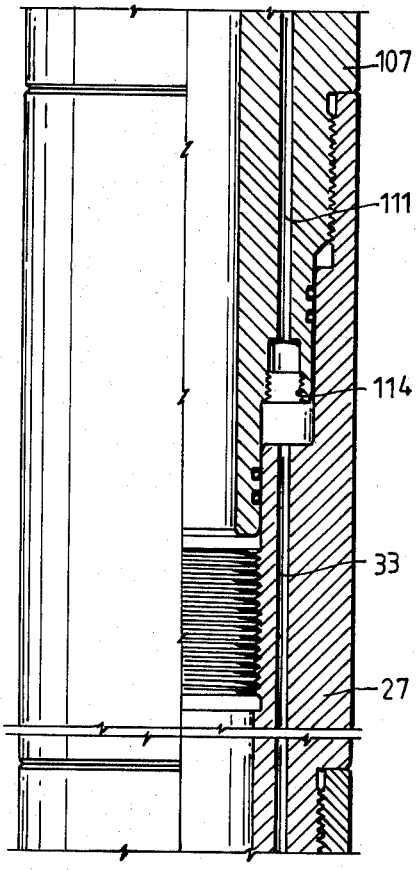
Fig. 4
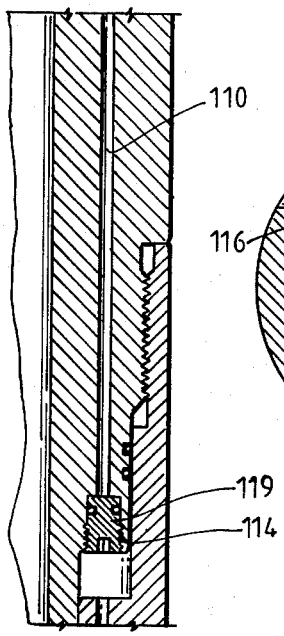
Fig. 6
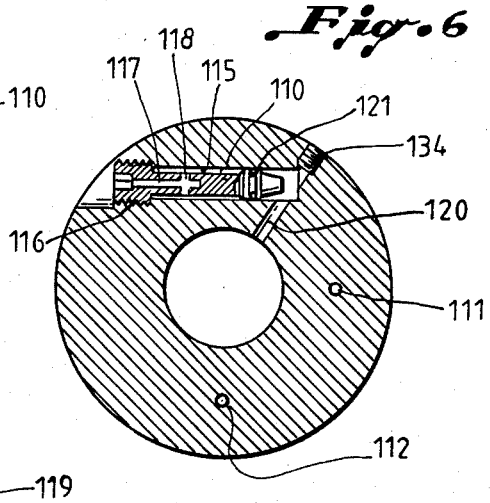
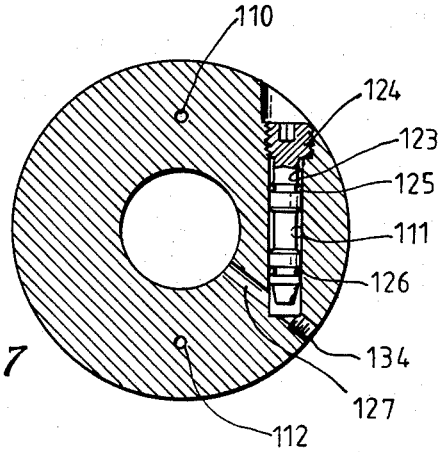
Fig. 7
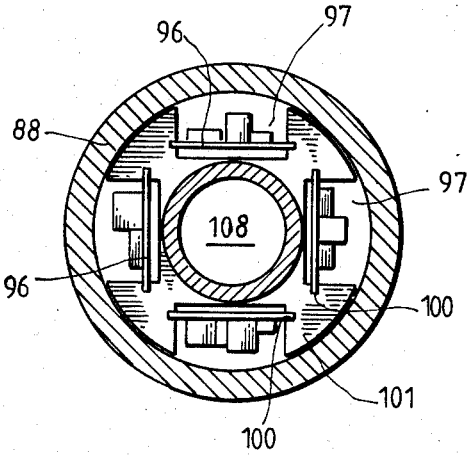
Fig. 5
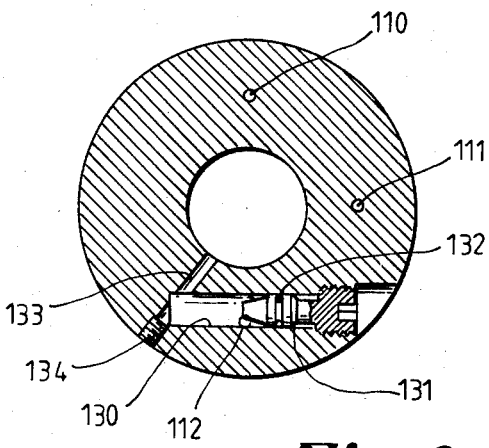
Fig. 8

Fig. 9
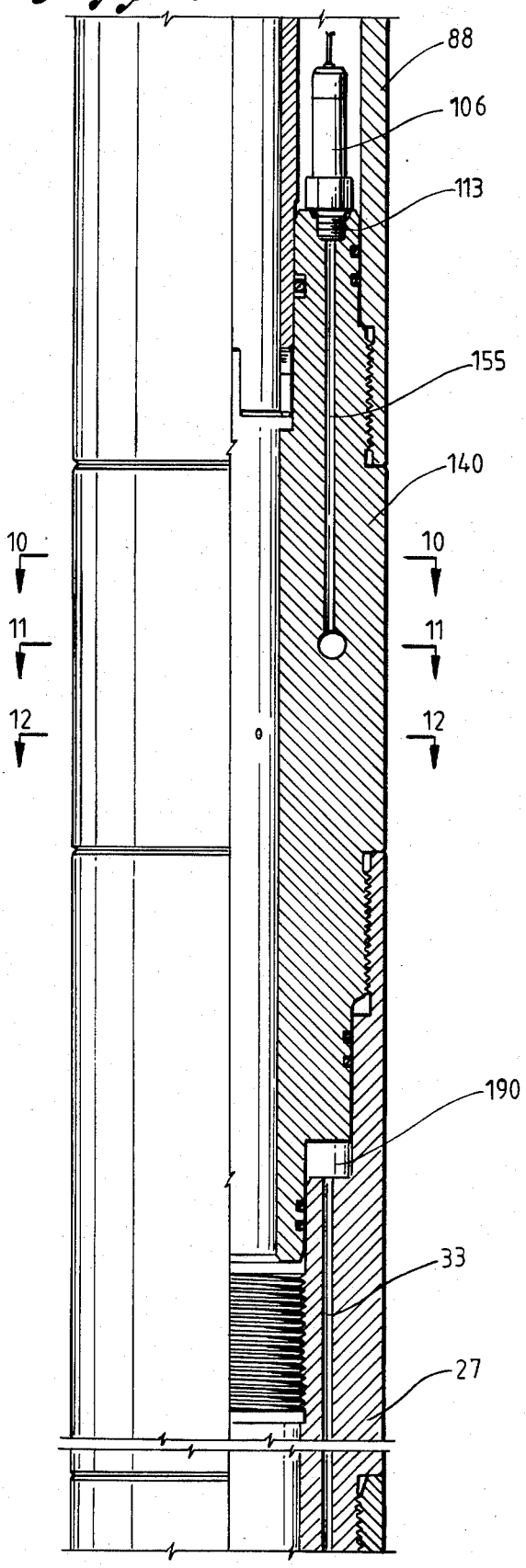
Fig. 10
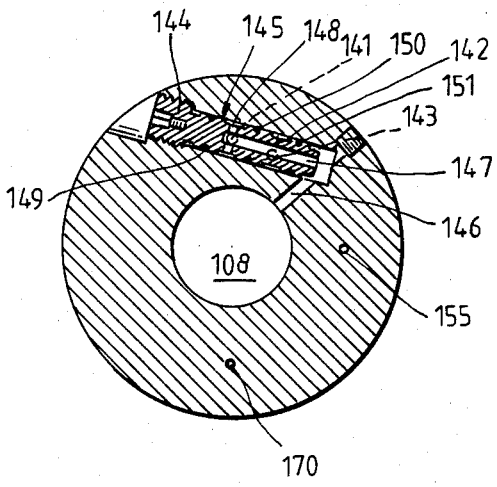
Fig 11
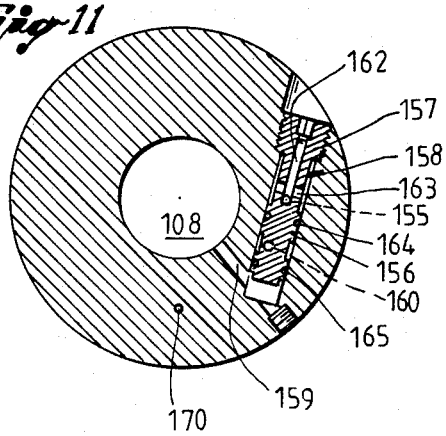
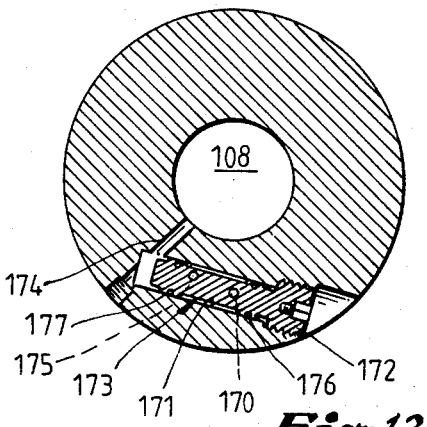
Fig 12

DRILL STEM TESTING APPARATUS WITH MULTIPLE PRESSURE SENSING PORTS

FIELD OF THE INVENTION

This invention relates generally to drill stem testing apparatus for use in conducting a formation test of a well, and particularly to a full-bore testing tool having a new and improved porting arrangement that enables the sensing and recording of pressures in various regions inside and outside the tool string during the course of a test.

BACKGROUND OF THE INVENTION

To conduct a drill stem test of an earth formation interval that has been intersected by a well bore, a packer and a normally closed test valve are lowered into the well on a pipe string, and the packer is set to isolate the formation interval to be tested. The test valve then is opened and closed for flow and shut-in periods of time, during which changes in the pressure of fluids in the well bore below the test valve are recorded by a gauge. The pressure data thus obtained may be analyzed when the test tool string is removed from the well, or while the test is in progress using known equipment and systems which enable a surface readout of the data.

Pressure data taken from various locations within the tool string and in the well bore are of interest from several standpoints. Of course measurements of the changes in pressure that occur below the test valve during the shut-in period of the test provide the basis for determining highly useful characteristics of the formation such as permeability and initial reservoir pressure. A knowledge of pressures below the test valve also enables the operator to monitor whether the test is proceeding properly and if the equipment is functioning in its intended manner. Various malfunctions such as tool plugging can be detected, and the respective durations of the flow and shut-in periods can be optimized. It also is very useful to know the pressure changes that are occurring inside the tool string above the test valve. From these pressures knowledge can be gained as to the amount and type of fluid recovery, as well as some of its characteristics such as density and specific gravity. Pressures above the test valve provide an indication of the operation of other valve systems in the tool string such as the operation of a reversing valve that is responsive to repeated applications of pressure to the interior of the pipe string. It also is desirable to monitor the pressure of fluids standing in the well annulus above the packer in order to determine that correct operating pressures are being applied to the fluids to cause actuation of the main test valve, as well as annulus pressure controlled sampler valves and circulating valves that may be included in the combination of tools being used. Leaks associated with the packer or the pipe string also may be detected by monitoring the pressure of fluids in the well annulus.

Prior drill stem testing equipment that applicant is aware of has not had the capability for making multiple pressure measurements of the type described above, and therefore has provided the tool operator at the surface with limited information as to the progress of the test and the operation of the equipment downhole.

It is accordingly a general object of the present invention to provide a new and improved full bore drill stem testing apparatus that includes a plurality of pressure transducers and separate porting arrangements to enable the measurement and recording of the pressures of well fluids in the tool string below and above the test valve as well as in the annulus adjacent the tool string.

Another object of the present invention is to provide a drill stem testing apparatus of the type described that includes separate ports for sensing the pressure of fluids above and below the main test valve and in the annulus adjacent the tool string, and means for communicating a selected one of the ports with a pressure transducer means.

Another object of the present invention is to provide a new and improved full bore drill stem testing apparatus having a multiple porting system for monitoring the pressures of fluids below and above the test valve as well as in the annulus adjacent the tool string, the porting system including plug components that are interchangeable in a manner such that different ports can be employed to sense selected ones of the pressures of interest.

SUMMARY OF THE INVENTION

These and other objects are attained in accordance with the concepts of the present invention through the provision of a well testing apparatus comprising a housing having a full-opening bore extending longitudinally therethrough, and test valve means for opening and closing said bore. A plurality of pressure transducers are mounted in the housing and are connected to a recording gauge in a manner such that pressure data obtained by each of the transducers can be separately recorded for transmission to the surface. A first port means is provided for directing pressure from a location in the tool string below the test valve to a first one of the transducers to enable recording of pressure draw down and build-up data, and a second port means is provided to direct pressure from a location in the tool string above the test valve to a second transducer to enable recording of pressure data associated with recovered well fluids and with changes in internal pressures. A third port means is provided to direct pressure from a location externally of the housing to a third transducer to enable recording of pressure data associated with annulus pressure changes that are indicative of tool operation in response to such changes. Thus a complete record of the various pressures of interest is obtained during the well testing operation, and can be transmitted to and read out at the surface to greatly increase the efficiency and reliability of the testing operation.

In one embodiment of the present invention, each of the port means includes a passage that extends longitudinally in the wall of a tubular transducer sub that is located above the test valve means and which forms a part of the housing. The pressure transducers are fixed in threaded sockets at the upper end of each passage, and threaded sockets also are provided at the lower end of each passage. A transverse bore which opens to the outside of the sub intersects each passage at a point between its ends, and a radial port is provided to communicate the inner end of each transverse bore with the interior of the sub. A port plug having a distinctive structural configuration is positioned and removably fixed in each of the transverse bores. The port plug that is associated with the passage which is included in the first port means carries seal elements that prevent communication between this passage and both the interior and the exterior of the sub. The lower end of this passage is in open communication with pressure in the tool string below the test value. The port plug that is associated with the passage which is included in the second port means carries a seal ring which prevents communication between this passage and the exterior of the sub, however, the passage is in open communication with the interior of the sub via the inner end of the port plug bore and the radial port that leads from the central bore of the sub to such inner end. A blanking plug is fixed in the threaded socket at the lower end of this passage so that the pressure which is sensed by the transducer at the upper end thereof is the pressure in the interior of the tool string above the test value. The port plug that is associated with the passage that is included in the third port means carries a seal ring which blocks communication between the inner end of the port plug bore and this passage, and the plug itself has ports that communicate the passage with the exterior of the sub so that the transducer at the upper end on the passage can be employed to sense well annulus pressures. The threaded socket at the lower end of this passage also is closed off by a blanking plug.

In another embodiment of the present invention, each of the passages that extend longitudinally in the wall of the transducer sub has upper and lower portions that are angularly offset from one another so that the passage portions intersect the respective transverse bores at spaced points along the axes of the transverse bores. A plug member that is received in one of the transverse bores connects the radial port at the inner end thereof with the upper passage portion and closes off the lower passage portion so that one of the transducers senses the pressure of fluids in the tool string above the test valve. A plug member that is received in another one of the transverse bores is arranged to communicate external pressure with an upper passage portion while closing off both the lower passage portion and the radial port at the inner of the transverse bore, so that a second transducer senses the pressure of fluids in the well annulus outside the tool string. A third plug member that is received in the remaining transverse bore is arranged to communicate the upper and lower passage portions that intersect this bore, so that a transducer at the upper end of this upper passage portion senses the pressure of fluids in the tool string below the test valve.

The provision of upper and lower passages that are offset as described above enables the plug members that are employed in the measurement of annulus pressure and internal pressure above the test valve to be constructed and arranged to close off the upper ends of the lower passage portions that intersect the transverse bore in which these plug members are mounted. Thus, separate blanking plugs as described in connection with the previous embodiment are not required, which has the advantage of permitting the location of the plug members to be changed on the rig floor without disassembling the tool.

Since the combinations of longitudinal passages, traverse bores, and radial ports that comprise each of the port means are identically constructed, it will be recognized that different ones of the port means can be used to sense a selected one of the various pressures of interest, depending upon how the various plugs are employed when the transducer sub is assembled. Of course, the same port plug can be positioned in two or more of the transverse bores to provide redundant or backup measurements. Thus, the present invention provides a versatile system that enables a complete record to be obtained of the pressure changes occurring inside and outside the tool string to greatly enhance the efficiency of the testing procedure.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIGS. 3A–3E are longitudinal sectional views, with portions in side elevation, of the sensor and recording tool of FIG. 2;

FIG. 4 is a fragmentary view showing a blanking plug installed at the lower end of the vertical passages that are used to sense annulus pressure and interior pressure above the test valve;

FIGS. 5–8 are cross-sections taken on lines 5—5, 6—6, 7—7 and 8—8 respectively of FIG. 3D;

FIG. 9 is a longitudinal sectional view, with portions in side elevation, of another embodiment of a transducer sub having multiple ports in accordance with the present invention; and FIGS. 10–12 are cross-sections taken on lines 10—10, 11—11, 12—12, respectively, of FIG. 9.

DETAILED DESCRIPTION OF PREFERRED EMBODIMENTS

Figure 1:
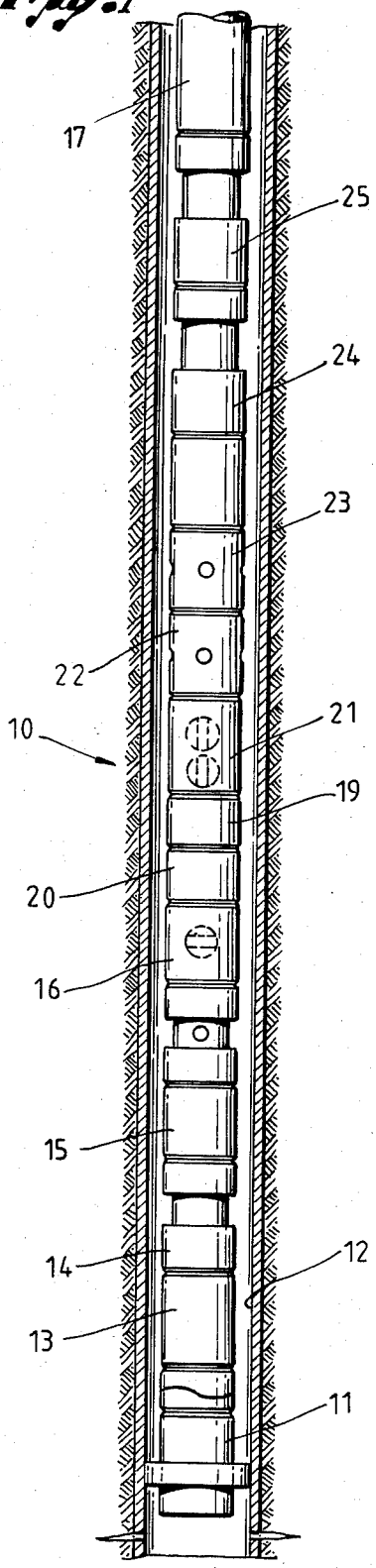
FIG. 1 is a schematic view of a drill stem testing tool string which incorporates the present invention and which is shown positioned in a well being tested.

Referring initially to FIG. 1, there is shown somewhat schematically a string of drill stem testing tools 10 disposed in a well being tested. The tool string includes a packer 11 having normally retracted packer elements that can be expanded into sealing contact with the surrounding well conduit wall, as well as normally retracted slips that are expanded to anchor the tool against downward movement. The packer 11 functions to isolate the formation interval to be tested from the hydrostatic head of the fluids in the well annulus 12 thereabove. Drill collars 13, a jar 14 and a recorder sub 15 may be connected between the packer 11 and a main test valve 16. The valve assembly 16 is a normally closed, full-opening device incorporating a ball valve element that can be opened to permit fluids in the earth formation intersected by the well bore to flow upwardly into the tool string, and then closed to shut in the formation and enable the recording of pressure build-up data. Of course such data is of considerable value in connection with subsequent completion decisions as will be apparent to those skilled in the art. The main test valve 16 preferably is arranged to be actuated in response to changes in the pressure of fluids in the annulus 12 so that manipulation of the pipe string 17 that extends upwardly to the surface is not required during the course of the test for safety reasons. A multi-sensor, recording and transmitting tool 20 that is constructed in accordance with the present invention is connected to the upper end of the main test valve 16, and will be described in considerable detail herebelow. An annular contact and latch tool 19 can be mounted on the upper end of the apparatus 20 and used in combination with a wireline connector apparatus to enable a surface read out of previously recorded data, or a read out of data on a real time basis. Of course, recorded data could be transmitted uphole and than further measurements transmitted in real time. A ball valve sampler tool 21 as described in U.S. Application Ser. No. 419,251, and reversing valves 22 and 23 as described respectively in Application Ser. No. 253,786, and 278,166, all assigned to the assignee of this invention, may be connected end-to-end above the tool 19, and to the lower end of the pipe string 17. Additional components such as a slip joint 24 and a slip joint safety valve 25 are typically included in the tool string 10.

Figure 2:
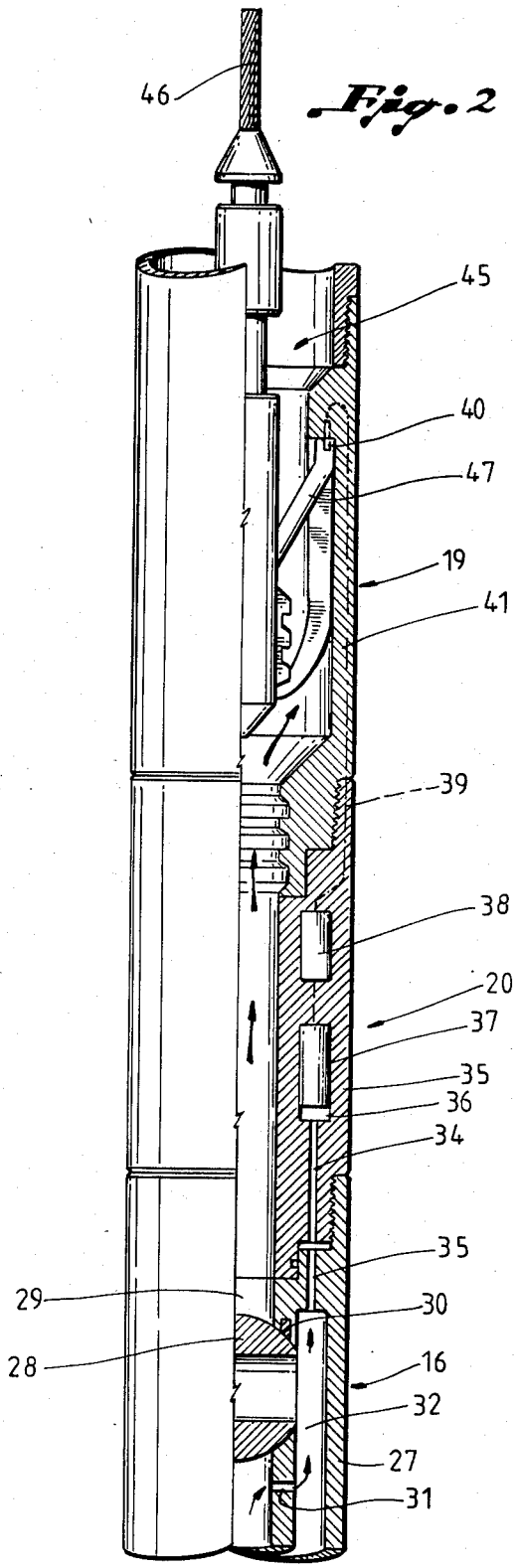
FIG. 2 is an enlarged schematic view of the multisensor and recording tool of the present invention mounted on the upper end of the pressure controlled test valve.

Referring now to FIG. 2 for a somewhat more detailed illustration of apparatus in which the present invention is embodied, the housing 27 of the test valve assembly 16 carries a ball valve element 28 that is rotatable between positions opening and closing the central bore 29 through the housing. When closed, the ball valve engages a seat 30 that surrounds the bore 29. The region of the bore 29 below the ball element 28 is communicated by a port 31, a passage 32 and another port 33 to a vertical passage 34 that extends upwardly through the housing 35 to a pressure transducer 36. The transducer 36 is connected to a recording gauge 37 that functions to store the data in a time sequence. Although not shown in FIG. 2, additional pressure transducers and other porting arrangements are provided to enable the measurement of pressures above the valve 28 as well as in the annulus outside the housing 35 as will be described in detail. The gauge 37 and its associated electrical circuitry are powered by a battery 38 that is mounted in an annular area between inner and outer walls of the housing 35. The output of the gauge 37 may be connected by one or more conductor wires 39 to an electrical contact 40 located on the wall of an extension housing 41 that is threaded to the upper end of the lower housing 35. The housing 41 forms a part of the annular electrical connector apparatus 19 that cooperates with a running tool indicated generally at 45 which can be lowered into the pipe 17 on an electrical wire line or cable 46 and into the bore on the housing 41. When in place, the running tool 45 can be actuated in an appropriate manner to cause an electrical connector that is located, for example, on the upper end of a pivotally mounted arm 47 to be extended outwardly where it is oriented and guided into engagement with the contact 40 during upward movement of the running tool within the housing 41. The engagement of the contacts enables the data stored in the recording gauge 37 to be transmitted via the cable 46 to suitable readout and recording equipment at the surface. The specific details of the running tool 45 and the receiver housing 41 are disclosed and claimed in copending U.S. application Ser. No. 422,246, also assigned to the assignee of this invention, and need not be set forth in further detail herein.

With reference to FIGS. 3A–3E, the multi-sensor and recording tool 20 of the present invention includes an upper sub 50 that is threaded at 51 to the lower end of an adapter sub 52 which forms a part of the electrical contact assembly 19. The sub 50 is provided with a longitudinally extending groove 49 in its outer periphery that is covered by a plate 53 and which receives a conductor wire that leads upwardly to the contact assembly 41. A generally rectangular window 54 is cut through the wall of the sub 50 to provide access to a feed-through connector 55 which is threadedly mounted on a bulkhead mandrel 56 that is positioned within the sub 50. The mandrel 56 has a locking sleeve 57 threaded to its upper end, and the sleeve cooperates with an inwardly directed housing shoulder 58 to fix the mandrel in a sealed manner within the sub 50. A female connector located within a boot 59 on the lower end of the conductor wire fits over the male pin of the connector 55 to make the connection in a typical manner. The lower end portion or the connector 55 extends through a vertical hole and through a retainer ring 48 that is fixed to the mandrel 56 by set screws or the like (not shown).

Figure 3A:
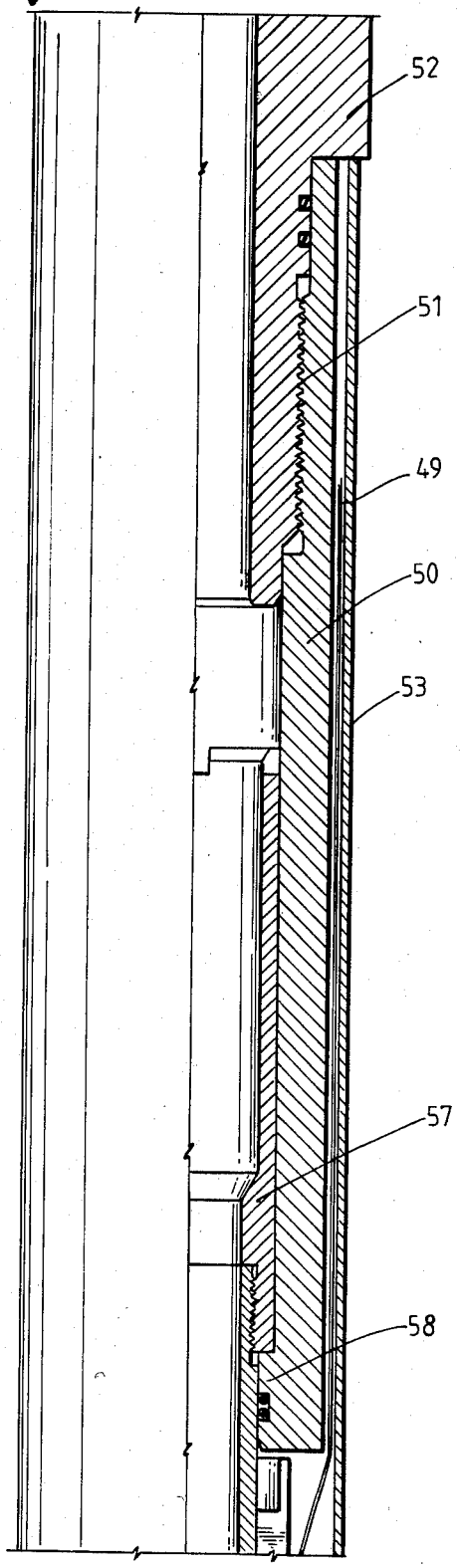
Figure 3B:
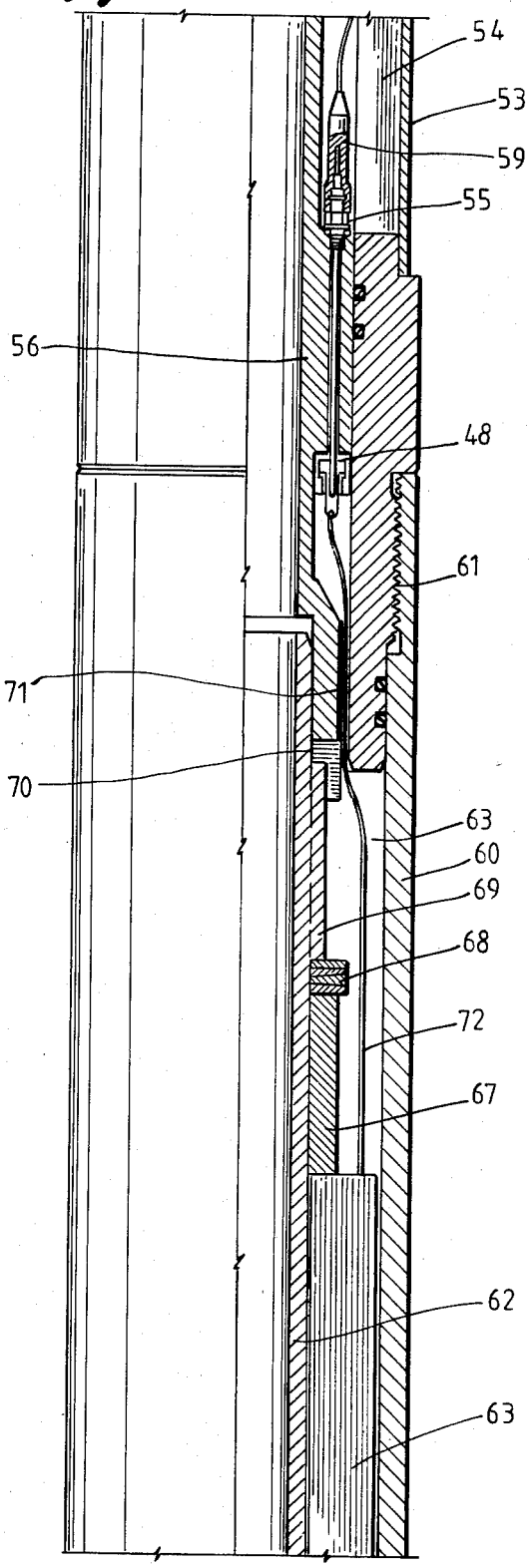
Figure 3C:
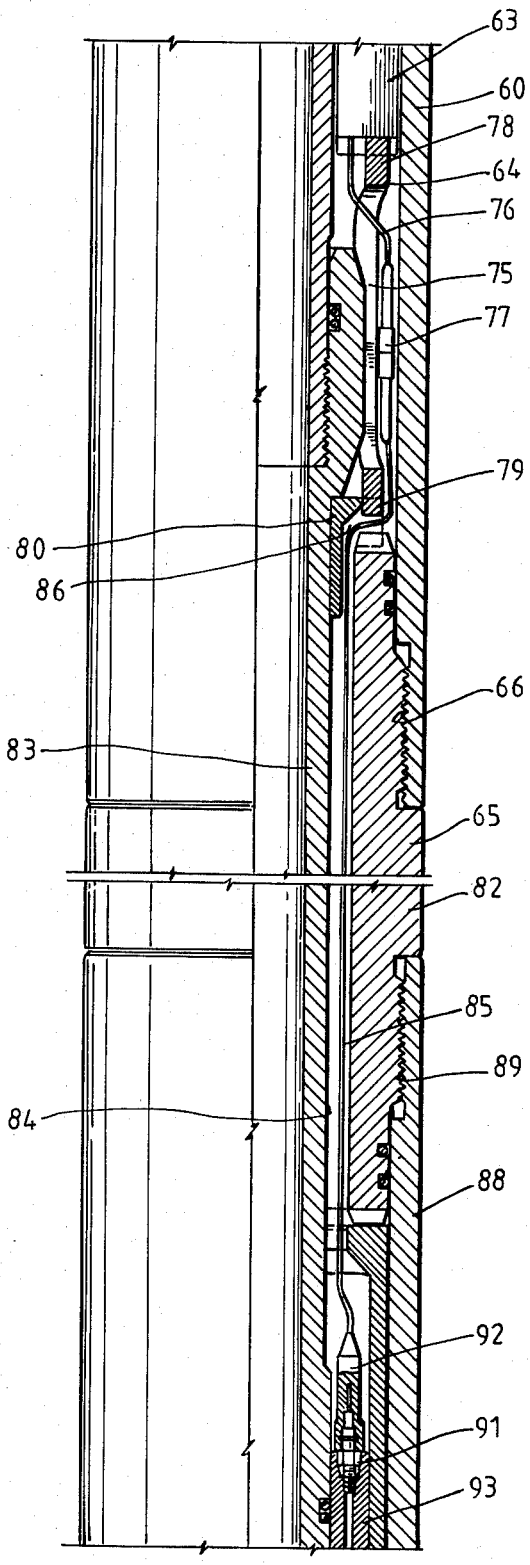

A tubular battery housing 60 is threaded at 61 to the lower end of the top sub 50, and together with a reduced diameter inner mandrel 62 provides an elongated annular area in which a battery 63 is mounted. The battery 63 may include a plurality of discrete cells that are packaged in an annular configuration. The lower end of the package rests on a spacer sleeve 64 as shown in FIG. 3C, and the spacer sleeve is interfitted with a cap 80 that is mounted on the upper end of a tubular lock housing 65. The lock housing 65 is threaded at 66 to the lower end of the battery housing 60. The upper end of the battery 63 may be engaged by another spacer sleeve 67 (FIG. 3B) which abuts against a spring and washer assembly 68 that is located below a shoulder on the mandrel 62. Splines 69 on the upper end portion of the mandrel 62 are engaged with slots 70 on the lower end of the bulkhead mandrel 56 to prevent relative rotation, and of course the various joints are sealed by suitable rings to prevent fluid leakage. One or more grooves 71 in the lower end portion of the mandrel 56 provide space for the passage of a conductor wire 72 which leads downwardly from the lower terminal of the connector 55.

The spacer 64 is formed with a plurality of windows or openings 75 which provide space for the positioning of electrical connectors 77 that are included in the electrical circuits as shown. Tabs 78 and 79 on the opposite ends of the spacer 64 engage in companion indentations on the lower end of the battery 63 and in the upper end of the cap 80 to prevent relative rotation of parts, and the cap 80 is fixed against rotation by tabs which fit into recesses on the upper end of a tubular lock housing 82. The housing 82 is threaded and sealed with respect to the lower end of the battery housing 60. A tubular lock mandrel 83 that has its upper end threaded to the battery mandrel 62 has its outer surface spaced laterally inwardly of the inner wall surface of the lock housing 65 to again provide an annular space 84 for the passage of conductor wires 85 that extend through one or more slots 86 formed in the outer periphery of the cap 80.

A circuit board housing 88 has its upper end threaded at 89 to the lower end of the lock housing 82. The housing 88 surrounds a carrier sleeve 90 (FIG. 3D) that has its enlarged upper end section threaded to the lower end of the lock mandrel 83. Several feed-through connectors 91 are mounted at the upper ends of bores extending longitudinally through the end section 93, with the lower ends of the connectors extending through a mounting ring 94 which is fixed to a lower face of the section by set screws or the like. The pins on the connectors 91 are mated with female boots 92 at the lower ends of conductor wires 85, and additional conductor wires 95 extend from the lower terminals of the connectors 91 to connections on the printed circuit boards 96 that carry the various electronic components which are included in the recording gauge 37.

The carrier sleeve 90 has a plurality of relatively wide, longitudinally extending recesses 97 formed on four sides thereof as shown in FIG. 5. Each of the recesses 97 has a pair of opposed guide slots 100 formed in the side walls thereof which receive the side edges of the circuit boards 96 in order to securely mount the same on the carrier sleeve 90. A retainer ring 98 (FIG. 3D) that is fixed to the carrier sleeve 90 by screws engages the lower edges of the circuit boards 96, and conductor wires 105 connect input terminals on the boards 96 to a plurality or pressure transducers 106 which are mounted in angularly spaced threaded bores in the upper end of a tubular transducer sub 107 which is threaded as shown to the lower end of the circuit board housing 88. The lower end of the carrier sleeve 90 is sealed within a counterbore in the inner upper end of the sub 107, and of course locking splines can be provided to aid in assembling the parts. The upper end of the transducer sub 107 is threaded to the lower end of the circuit board housing as shown.

Figure 3D:
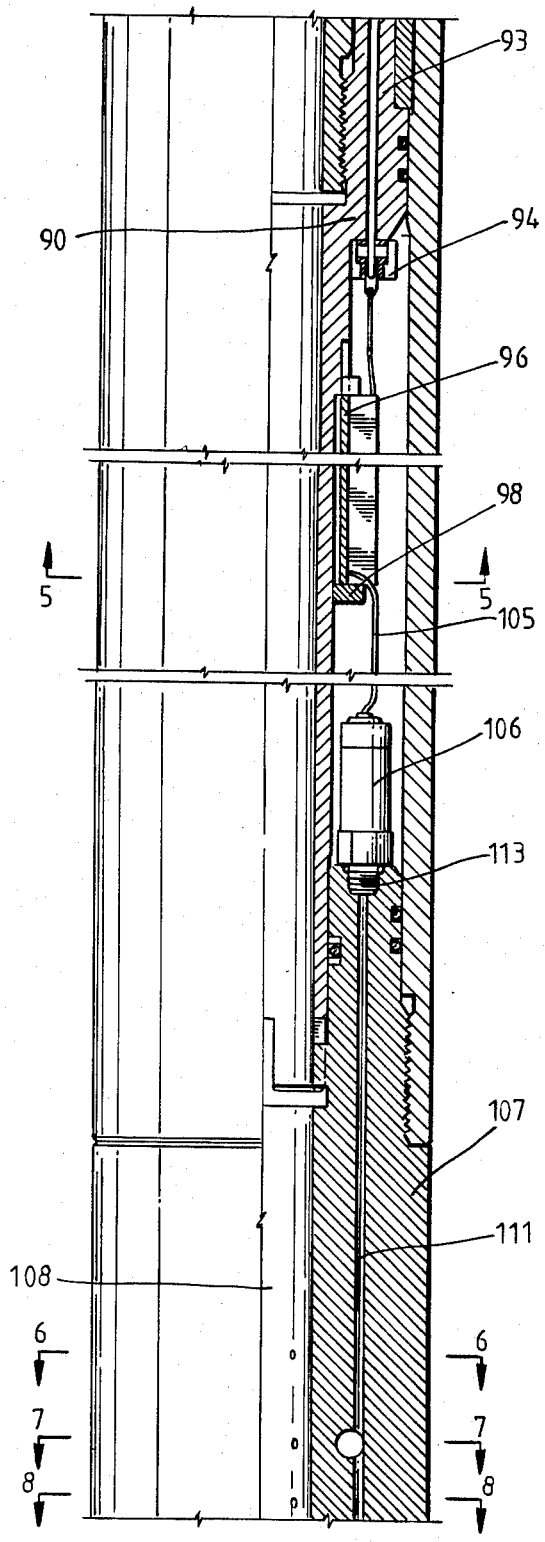

In one form of the multiple porting construction in accordance with the present invention, the transducer sub 107 is provided with three angularly spaced ports that extend vertically through the wall thereof between threaded sockets 113 at the upper end of the sub and threaded sockets 114 near the lower end of the sub. One port 111 is shown in FIGS. 3D and 3E, and this port as well as the other two ports 110 and 112 are shown in the cross-sectional FIGS. 6–8. As previously mentioned, a pressure transducer 106 is screwed into each of the upper threaded sockets 114. As shown in FIG. 6, the port 110 is intersected by a transverse bore 115 that is threaded at its outer end to receive a plug member 116. The plug 116 is provided with a central opening 117 that is communicated by side openings 118 to the annular area outside the plug which is in open communication with the port 110. In this manner the pressures of fluids in the well annulus outside the sub 107 are fed to the port 110 where such pressures can be sensed by the transducer 106 which is mounted in the threaded bore 113 at the top thereof. The lower end of the port 110 is blanked off by a threaded plug 119 as shown in FIG. 4. The sub 107 also is provided with a radially extending port 120 which opens into the bore 108 and which intersects the inner end of the transverse bore 115. The plug 116 is provided with an enlarged section which carries a seal ring 121 that seals against the wall of the transverse bore 115 in order to block communication between the ports 120 and 110.

The second port 111 in the transducer sub 107 is intersected by a transverse bore 123 that is threaded at its outer end for reception of another port plug 124 as shown in FIG. 7. This port plug carries seal rings 125, 126 located on opposite sides of a reduced diameter section thereof, and the seal rings engage the wall of the bore 123 on opposite sides of the port 111. Here again a radially directed port 127 is provided which leads from the inner end of the bore 123 to the central bore 108 of the sub 107, however fluid communication between the vertical port 111 and the radial port 127 is blocked by the seal ring 126. The lower end of the port 111 is in communication via the passages 33 and 32 with the pressure below the test valve 28 so that this pressure is transmitted to the transducer 106 at the upper end of the port 111. Although a threaded socket 114 is provided at the lower end of the port 111 as shown in FIG. 3E so that blanking plugs can be readily interchanged, the plug is omitted in this instance.

The third port 112 in the sub 107 is intersected by a transverse bore 130 as shown in FIG. 8. The bore 130 receives a threaded port plug 131 that carries a seal ring 132, and the inner end of the bore 130 is in communication with a radial port 133 in the sub 107 that opens into the bore 108 thereof. The lowermost end of the vertical port 112 is closed by a threaded plug of the type shown in FIG. 4. Thus the port 112 is subjected to the pressure of fluids in the bore 108 of the sub 107 at a location above the test valve 28, so that the pressure transducer 106 at the upper end thereof can sense such pressures and provide an output that is recorded in the gauge.

Each of the radial ports 120, 127 and 133 initially is made to extend entirely through the wall of the sub 107 for convenience of manufacture, however in each case the outer end of the port is closed off by a fitting 134 so that these ports function to communicate only between the bore 108 and the inner ends of the respective transverse bores.

As shown in FIG. 3E, the lower end of the transducer sub 107 is threaded to the upper end of the tester housing 27 which has the port 33 formed therein. The port 33 leads to an annular area below the threaded sockets 114, however the pressure from below the valve element 28 can only enter the sub port 111 since the lower ends of the ports 110 and 112 are closed off by blanking plugs 119 as previously described.

Another embodiment of the present invention is shown in FIG. 9 and in cross-sectional views 10–12. As in the case of the previously described embodiment, a transducer sub 140 has its upper end threaded to the lower end of the housing 88 and its lower end threaded to the upper end of the tester housing 27. Passage 33 in the housing 27 leads to an annular region 190 adjacent the lower end of the sub 140 in order to place this region in communication with the pressure of fluids within the housing below the main test valve 28. The upper end of the sub 140 is provided with three threaded sockets 113 that are angularly spaced at approximately 90°, and a pressure transducer 106 is mounted in each of the sockets.

With reference to FIG. 10, a vertical passage 141 shown in phantom lines has its upper end in communication with one of the sockets 113 and extends downwardly to a point of intersection with a transverse bore 142 that is formed in the wall of the sub 140. Another vertical passage 143 extends downwardly from the bore 142 to the annular region 190, and the passage 143 is angularly offset with respect to the passage 141 so as to intersect the bore 142 at a point that is axially spaced from the point of intersection of the passage 141 with the bore 142. The outer end of the transverse bore 142 is threaded for reception of the head 144 or a port plug 145, and the inner end of the bore 142 is connected to the central bore 108 of the sub 140 by a radial port 146.

The port plug 145 is provided with a central opening 147 and side openings 148 which communicate the radial port 146 with the vertical passage 141. A seal ring 149 closes off the radial bore to external pressure, and seal rings 150 and 151 close off the upper of the lower vertical passage 143. Thus, the pressure transducer 106 that is located at the upper end of vertical passage 141 senses internal pressure above the main test valve 28 via the radial port 146, the plug openings 147 and 148, and the vertical passage 141. Since the upper end of the lower vertical passage 143 is closed off as described above, a separate blanking plug for the lower end of the passage is not required as in the case of the previously described embodiment.

With reference to FIG. 11, a second vertical passage 155 that extends downwardly in the wall of the upper portion of the sub 140 leads from another one of the sockets 113 to a point of intersection with another transverse bore 156. Here again, the bore 156 has its outer end threaded for reception of the head 157 of a port plug 158, and its inner end communicated with the bore 108 of the sub 140 by a radial port 159. A lower vertical passage 160 that opens into the annular region 190 intersects the bore 156 at a point that is spaced from the point of intersection of the vertical passage 155.

The port plug 158 has a central opening 162 and side openings 163 that communicate the pressure externally of the sub 140 with the upper vertical passage 155, so that the pressure transducer 106 at the upper end of this passage senses changes in the pressure of well fluids in the annulus 12. The plug 158 carries spaced seal rings 164, 165 that engage surround wall surfaces of the bore 156 in a manner to close off the upper end of the lower vertical passage 160, as well as the outer end of the radial port 159. In view of the fact that the vertical passage 160 is closed off in this manner, a separate blanking plug is not required.

As indicated in FIG. 12, a third vertical passage 170 extends downwardly through the wall of the sub 140 from the remaining one of the sockets 113 to an intersection shown in phantom lines with a third transverse bore 171. The outer end of the bore 171 is threaded for reception of the head 172 of a port plug 173, and a radial port 174 again leads from the inner end of the bore 171 to the central bore 108 of the sub 140. A lower vertical passage 175 that is offset from the upper vertical passage 170 extends from the bore 171 to the annular region 190. Seal rings 176, 177 on the port plug 173 block communication of internal and external pressures with the vertical passages 170, 175, however, these passages are in communication with one another so that the pressure transducer 106 at the upper end of the passage 170 senses the pressures of fluids in the tool string below the test valve 28.

It will be recognized that since the constructional arrangement of the transverse bore, vertical passages and radial port shown in each of the FIGS. 10–12 is identical, the port plugs can be interchanged to provide for a selected pressure measurement. Moreover, the same port plug can be used in two or more of the transverse bores to provide redundant or backup measurements.

If desired, suitable indicia can be placed on the respective port plugs to aid in assembly. For example, the port plug 145 could have a notch (not shown) formed on the interior of the head 144 to indicate that internal pressure would be measured where using this particular plug. An external notch can be provided on the head 157 of the plug 158 to indicate that annulus pressure would be the point of measurement when using this plug. The other port plug 173 would not be notched to indicate that pressure below the test valve will be measured when using this plug.

OPERATION

In operation, the test tool string assembled as shown in the drawings is lowered into the well on the pipe string 17, and the packer 11 is set by appropriate manipulation of the pipe in order to isolate the interval of the well to be tested. The main test valve 16 then is opened in response to the application of pressure at the surface to the well annulus, and the ball valve element 28 is left open for a flow period of time that is of a sufficient length to draw down the pressure in the isolated interval. Then the pressure being applied at the surface to the annulus is released to enable the valve element 28 to close, so that the interval is shut in for a period of time during which pressure build-up data is acquired. Of course the valve 16 can be opened and closed for additional cycles of operation during which additional pressure data can be obtained.

The pressure of fluids within the bore of the tool string below the test valve 28 is transmitted to one of the transducers 106 so that data representative of pressure build-up is stored in one channel of the recording gauge 17. Pressures within the bore 108 of the tool string above the valve 16 are transmitted to another of the transducers 106 and the data is stored in another channel of the gauge. Annulus pressure are transmitted to the other transducer 106 and are recorded in a third channel in the gauge. The changes in the pressure of fluids below the test valve provides the pressure build-up data which is the principle objective of conducting the test. From this data a knowledge of initial formation pressure, permeability of the formation, and other significant parameters of the reservoir can be determined. Of course it is also possible to detect tool plugging or other malfunction from this data. A record of the pressures of fluids within the bore 108 above the valve can be used to determine the amount and type of fluid recovery, as well as certain characteristics thereof, and to monitor the operation of reversing valves that respond to interior pressure. The annulus fluid pressure can be monitored to determine that correct operating pressures are being applied to cause actuation of the main test valve, as well as other valves that are operated by annulus pressure changes such as sampler valves and circulating valves. Annulus pressures will also be indicative of any leaks that may be present in the pipe string. Thus the present invention provides for the measurement and recording of all the various pressures that may be of interest during the test.

The data can be transmitted to the surface prior to removal of the tool string from the well by lowering the running tool 45 into the pipe 17 on the wireline 46, and operating the tool so that an electrical connection is made with the contact 40. Previously recorded data can be transmitted in this manner, or data can be read out on a real time basis. Of course, it also is possible to read out recorded data and then continue with the read out of data in real time. If the data is not recovered in this manner, or if the connector apparatus 19, 45 is not used, the data can be read out when the tool string 10 is removed from the well.

The construction and arrangement of the porting of the present invention is particularly advantageous since the vertical and radial ports are all formed in the sub 107 or 140 in the same manner. The pressure being measured, whether below or above the valve or in the annulus, is selected by use of a particular port plug and placement of the blanking plugs in the proper bores. The plugs are readily interchangeable in a convenient manner.

Although the present invention has been described in connection with an annulus pressure operated tool system that typically is used in connection with the testing of offshore wells, the invention has equal application to a mechanically operated test tool system that employs a full-opening main test valve that is opened and closed in response to manipulations of the pipe string. Such mechanically operated test tools might be used in either inland or offshore wells.

It now will be recognized that a new and improved multiple sensor and recording tool has been provided that includes ports and transducers for monitoring the changes in fluid pressures that occur during the test in internal areas of the test tool above and below the test valve, as well as in the annulus outside the test valve housing. Since certain changes or modifications may be made in the disclosed embodiment without departing from the inventive concept involved, it is the aim of the appended claims to cover all such changes and modifications falling within the true spirit and scope of the present invention.

What is claimed is:

1. Well testing apparatus, comprising:
a tubular housing having a bore therethrough;
a valve for opening and closing said bore;
a pressure transducer mounted in the wall of said housing for sensing well fluid pressure and providing an indication thereof;
first, second and third passages in said wall for respectively communicating said transducer with fluid pressures at first, second and third locations external of said wall, each of said passages joining at least one other of said passages; and
user settable plug means positioned at said passage junctions for communicating a selected one of said first, second and third location pressures with said pressure transducer.

2. Well testing apparatus as in claim 1, wherein said first location is a location in said bore below said valve, said second location is a location in said bore above said valve, and said third location is a location external of said housing.

3. Well testing apparatus comprising:
a housing having a full-opening bore therethrough;
a valve for opening and closing said bore;
a plurality of pressure transducers mounted in said housing for sensing well fluid pressures and providing an indication thereof;
a first port for directing pressure from a location inside said housing below said valve to a first one or said transducers;
a second port for directing pressure from a location inside said housing above said valve to a second one of said transducers; and
a third port for directing pressure from a location externally of said housing to a third one of said transducers;
wherein said housing includes a tubular sub, said first port including a first passage extending longitudinally in the wall of said sub between threaded bores at the opposite ends thereof, said one transducer being mounted in one of said threaded bores and the other threaded bore being open.

4. The apparatus of claim 3 further including a transverse bore extending in the wall of said sub, said transverse bore intersecting said passage and extending to an exterior opening in the outer surface of said sub, a radial port communicating between the interior bore of said sub and the inner end of said transverse bore, and plug means inserted into said transverse bore through said exterior opening and fixed therein, said plug means preventing communication between said passage and said radial port and between said passage and said exterior opening.

5. The apparatus of claim 4 wherein said plug means comprises a stem having first and second seal rings mounted thereon, said first seal ring engaging a wall surface of said transverse bore at a location between the point of intersection of said passage with said transverse bore and said exterior opening, said second seal ring engaging a wall surface of said transverse bore between said point of intersection and said inner end of said transverse bore.

6. Well testing apparatus comprising:
a housing having a full-opening bore therethrough;
a valve for opening and closing said bore;
a plurality of pressure transducers mounted in said housing for sensing well fluid pressures and providing an indication thereof;
a first port for directing pressure from a location inside said housing below said valve to a first one of said transducers;
a second port for directing pressure from a location inside said housing above said valve to a second one of said transducers; and
a third port for directing pressure from a location externally of said housing to a third one of said transducers;
wherein said housing includes a tubular sub having a central bore, said second port incuding a second passage extending longitudinally in the wall of said sub between threaded bores at the opposite ends thereof, said second transducer being mounted in one of said threaded bores, and a blanking plug engaged in the other of said threaded bores.

7. The apparatus of claim 6 further including a transverse bore extending in the wall of said sub, said transverse bore intersecting said second passage and extending to an exterior opening in the outer surface of said sub, a radial port communicating between the central bore of said sub and the inner end of said transverse bore, and plug means inserted into said transverse bore through said exterior opening and fixed therein, said plug means preventing communication between said second passage and said radial port and permitting communication between said second passage and said exterior opening.

8. The apparatus of claim 7 wherein said plug means comprises a stem having a seal ring mounted thereon, said seal ring engaging a wall surface of said transverse bore at a location between the point of intersection of said second passage with said transverse bore and said inner end of said transverse bore, said plug means having means formed therein for communicating said second passage with the exterior of said sub.

9. Well testing apparatus comprising:
a housing having a full-opening bore therethrough;
a valve for opening and closing said bore;
a plurality of pressure transducers mounted in said housing for sensing well fluid pressures and providing an indication thereof;
a first port for directing pressure from a location inside said housing below said valve to a first one of said transducers;
a second port for directing pressure from a location inside said housing above said valve to a second one of said transducers; and
a third port for directing pressure from a location externally of said housing to a third one of said transducers;
wherein said housing includes a tubular sub having a central bore, said third port including a third passage extending longitudinally in the wall of said sub between threaded bores at the opposite end thereof, said third transducer being mounted in one of said threaded bores, and a blanking plug engaged in the other of said threaded bores.

10. The apparatus of claim 9 further including a transverse bore extending in the wall of said sub, said transverse bore intersecting said third passage and extending to an exterior opening in the outer surface of said sub, a radial port communicating between the central bore of said sub and and the inner end of said transverse bore, and plug means inserted into said transverse bore through said exterior opening and fixed therein, said plug means preventing communication between said third passage and said exterior opening, said third passage and said radial port being in open communication.

11. The apparatus of claim 10 wherein said plug means comprises a stem having a seal ring mounted thereon, said seal ring engaging a wall surface of said transverse bore between the point of intersection of said third passage with said transverse bore and said exterior opening.

12. Apparatus for use in sensing pressures during a drill stem test of a well, comprising:

an elongated tubular member leaving a central bore;

a first port including a first passage extending longitudinally in the wall of said member between oposite end surfaces thereof, a first transverse bore intersecting said first passage and extending to an exterior opening in the outer surface of said member, and a first radial port communicating between said central bore and the inner end of said first transverse bore;

a first plug inserted into said transverse bore and fixed therein, said plug including a stem that carries seal means for preventing communication between said passage and said radial port and between said passage and said exterior opening;

a second port including a second passage extending longitudinally in the wall of member between opposite end surfaces thereof, a second transverse bore intersecting said second passage and extending to an exterior opening in the outer surface of said member, and a second radial port communicating between said central bore and the inner end of said second transverse bore;

a second plug inserted into said second transverse bore and fixed therein, said second plug including a stem that carries seal means for preventing communication between said second passage and said second radial port, said second plug having means formed therein for communicating said second passage with the exterior of said member;

means for closing off one end of said second longitudinal passage;

a third port including a third passage extending longitudinally in the wall of said member between opposite end surfaces thereof, a third transverse bore intersecting said third passage and extending to an exterior opening in the outer surface of said member, and a third radial port communicating between said central bore and the inner end of said third transverse bore; and a third plug inserted into said third transverse bore and fixed therein, said third plug including a stem that carries seal means for preventing communication between said third passage and the exterior of said member, the inner end of said third transverse bore and said third radial port being in open communication; and means for closing off one end of said third longitudinal passage.

* * * * *